United States Patent [19]

Caruso et al.

[11] Patent Number: 4,742,268

[45] Date of Patent: May 3, 1988

[54] HIGH COLOR RENDERING CALCIUM-CONTAINING METAL HALIDE LAMP

[75] Inventors: Nancy J. Caruso, Livingston; Michael H. Masto, Bloomfield, both of N.J.

[73] Assignee: North American Philips Electric Co., New York, N.Y.

[21] Appl. No.: 922,442

[22] Filed: Oct. 20, 1986

Related U.S. Application Data

[60] Division of Ser. No. 771,483, Sep. 3, 1985, Pat. No. 4,643,690, which is a continuation of Ser. No. 493,176, May 10, 1983, abandoned.

[51] Int. Cl.[4] ..... H01J 61/073; H01J 61/18; H01J 61/30

[52] U.S. Cl. ..... 313/620; 313/621; 313/634; 313/638

[58] Field of Search ..... 313/573, 574, 620, 621, 313/631, 634, 638

[56] References Cited

U.S. PATENT DOCUMENTS 4,161,672 7/1979 Cap et al. ..... 313/620
4,594,529 6/1986 de Vrijer ..... 313/620 X

*Primary Examiner*—David K. Moore
*Assistant Examiner*—K. Wieder
*Attorney, Agent, or Firm*—David R. Treacy

[57] ABSTRACT

A metal halide lamp provides exceptional color rendition because of a high calcium iodide partial pressure. A long-arc ellipsoidal arc tube provides a high "cold spot" temperature. The method of manufacture of the lamp includes heating the arc tube tubulation while burning the lamp after dosing, and then an evacuation step to eliminate moisture due to the hygroscopic calcium iodide.

4 Claims, 2 Drawing Sheets

HIGH COLOR RENDERING CALCIUM-CONTAINING METAL HALIDE LAMP

This is a division of application Ser. No. 771,483, filed Sept. 3, 1985, now U.S. Pat. No. 4,643,690, which is a continuation of Ser. No. 493,176 filed 5-10-83 now abandoned.

BACKGROUND OF THE INVENTION

1. Field of the Invention

The invention relates to lamps that provide good color rendition of a wide range of colors, while having much greater efficiency than an incandescent lamp; and more particularly, to high intensity discharge lamps having metal halide additives in the arc tube.

The color characteristics of light sources have become increasingly important as architects and designers use light as an element in the design of a room or a structure. In the past, good color rendition, lamp-to-lamp color uniformity and color shift over the life of the lamp, and a desirably low correlated color temperature have dictated the use of either tungsten-halogen lamps or certain deluxe phosphor-coated mercury HID lamps. However, in circumstances where high efficiency is desired, or a more compact source than the typical fluorescent tube are desired, neither of these lamp sources have proved to be entirely satisfactory. To fill this gap, there has been interest and experimentation in the development of metal halide high intensity discharge lamps for over two decades. However, certain disadvantages of these lamps have limited their use in critical applications.

2. Description of the Prior Art

Early sodium iodide/scandium triiodide lamps, such as described in U.S. Pat. No. 3,407,327, while having better color properties than simple metal vapor arcs, were still not able to provide the desired color rendition, particularly in the red region, and had undesirably high color temperature, lamp-to-lamp color variation, and color shift over the lamp life. Lamps using a tin halide additive have been shown to provide excellent color rendering properties, but have an undesirably high color temperature where the tin halide is the only significant additives.

A promising attempt to overcome these disadvantages is described in U.S. Pat. No. 4,360,758, hereby incorporated by reference, which describes a calcium/-thallium/tin iodide discharge which provides excellent color rendering properties and control of the correlated color temperature. However, in order to obtain sufficient vapor pressure from the calcium iodide component of the filling, so as to have good red emission, it is necessary to operate the lamp so that the arc tube has a cold spot temperature which is greater than 750° C. This has been achieved by overwattage operation, which increases the wall loading of the arc tube, or requires the use of formed niobium or nickel end caps to elevate the cold spot temperature of the arc tube.

Another approach to the improvement of color rendering has involved the use of short arc lengths with relatively high vapor pressure. Metal halide lamps of this sort are described in an article by Fromm, Seehawer, and Wagner in *Lighting Research and Technology* 11,1 (1979). Of particular interest in this article is the comparison of the temperature distribution of a conventional long arc metal halide lamp, and a lamp whose arc tube has bell-shaped ends so as to achieve a more nearly isothermal temperature distribution along the arc tube. An alternative design described in that article involves a rounded arc tube used for a short arc 250 watt metal halide lamp, which showed a temperature variation between cold spot and hot spot of only 80° C. in the horizontal position, and 85° C. in the vertical position. However, when data for this lamp in both vertical and horizontal operation are superimposed, it becomes clear that there is a far greater total variation, and that the cold spot temperature is much too low if the additives include a material such as calcium iodide. Thus, the isothermal effect desired is not achieved by the configuration shown, if a lamp is to be useable in both orientations.

A further problem encountered in the manufacture of high color rendering metal halide lamps is related to the hygroscopic properties of the additives. The hygroscopic nature of sodium iodide salts has required the development of arc tube filling and processing techniques by which the tube may be repeatedly evacuated and flushed, and care is exercised that the additive salts be protected from moisture contamination. Experimental use of an additive fill such as that taught in the U.S. Pat. No. 4,360,758 has, however, shown excessive difficulty in starting because of the even greater hygroscopic nature of the calcium iodide additive. This problem has not proved solvable by any of the known techniques that are useable in manufacture of production quantities.

For example, one in situ purification method involves "torching." After an arc tube has been flushed, and additives have been added, the arc tube is locally heated at the location of the dosed additives, so that they evaporate and condense elsewhere. This may be performed while the tube is evacuated or contains argon. Before the tube has cooled off, it is again evacuated, then cooled, then given the final filling, and is tipped off (tubulation sealed off). During this process some of the additives are drawn off into the evacuation system, so that lamp-to-lamp non-uniformities result. Further, the iodide additives used are corrosive and damaging to the vacuum system.

SUMMARY OF THE INVENTION

In accordance with the invention, an isothermally shaped arc tube is substantially ellipsoidal in shape, so proportioned that the principal electrodes pass through the ellipsoid foci near the electrode tips. Preferably, the ellipsoid has circular symmetry about a longitudinal axis which is the major ellipsoid axis, and the electrode tips lie substantially along that axis, spaced so as to define an arc length which is at least 75% of the distance between the ellipsoid foci.

In a preferred embodiment of a 250 Watt metal halide lamp, the arc length is at least 80% of the distance between the ellipsoid foci, and preferably is approximately 83% of that distance. For improved color rendition properties, in this embodiment the ionizable material is an additive fill of calcium iodide, thallium iodide, and tin iodide, and the arc tube is proportioned such that, when operated at rated wattage, the cold spot temperature on the arc tube is at least 770° C. when installed in any orientation.

In a still further preferred embodiment, the ionizable material comprises as additives approximately 0.1 mg/cc thallium iodide, 0.65 mg/cc tin iodide and 1.375 mg/cc calcium iodide, and the lamp has a rated wattage such that the maximum operating temperature along the arc tube wall is less than 1000° C., whereby a color preference index greater than 100 is provided without sacrificing lamp life.

According to another aspect of the invention, an arc tube for a metal halide lamp, having an additive which includes calcium iodide or other extremely hygroscopic materials, includes at least one cycle of burning after dosing of the tube with the additive materials, followed by complete cooling of the arc tube, and then evacuation prior to the final gas and/or mercury filling.

Preferably, after dosing of the arc tube with additive materials through the tubulation, the arc tube is back filled with a quantity of ionizable gas such as argon; the tubulation is then tipped off at a location spaced from the arc tube; a heater tube is closely fitted around and along the entire length of the tubulation, and the tubulation is heated to an elevated temperature; and after the elevated temperature has stabilized, an arc is lit between the main electrodes of the arc tube and maintained at least at the rated wattage for 5 to 10 minutes; the arc is then extinguished and the heater tube is permitted to cool at a rate much slower than the rate of cooling of the arc tube, such that the additive materials condense within the arc tube rather than the tubulation; the tubulation is then broken to establish communication with a vacuum source, and the arc tube is evacuated, and then filled with the desired quantity of ionizable material; and the tubulation is then tipped off adjacent the arc tube.

In the preferred embodiment of this method, the step of tubulation heating comprises heating the tubulation to a temperature between approximately 700° and 800° C. for a period of at least approximately 5 minutes.

In a still further preferred embodiment, especially adapted for manufacturing an arc tube containing a calcium iodide additive, the back filling step immediately following dosing comprises back filling to a pressure of between approximately 25 and 50 Torr of argon, and the tubulation is then tipped off at a distance of at least approximately 75 mm from the arc tube.

As a result of this invention, a lamp is provided which has a far greater life than the heavily loaded high pressure short arc lamp described in the Fromm article in *Lighting Research*, and yet has superior color rendering, because of the limited maximum wall temperature combined with high calcium iodide partial pressure.

DESCRIPTION OF THE PREFERRED EMBODIMENTS

Lamp Construction

Figure 1:
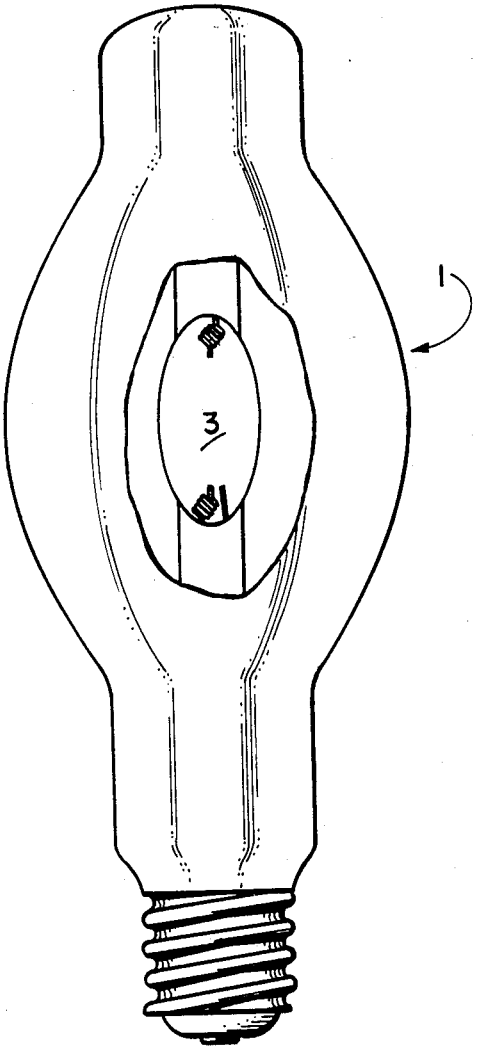
FIG. 1 is a front view, partially cut away, of a Mogul screw base lamp having an arc tube in accordance with the invention, the arc tube being shown exaggerated in size for clarity.

The high intensity discharge lamp 1 shown in outline in FIG. 1 is generally of a type which may be suitable for a 250 Watt metal halide lamp in accordance with the invention, and uses a BT 28 bulb and base. The arc tube 3, shown only diagrammatically in this view, is supported within the lamp envelope, and has electrical connections to the arc tube made in any of the manners well known in the art. The outer bulb is, preferably, evacuated.

Figure 2:
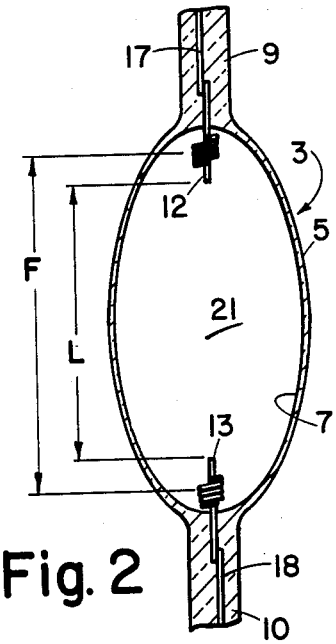
FIG. 2 is a sectional side view of the arc tube of FIG. 1, at an enlarged scale.
Figure 3:
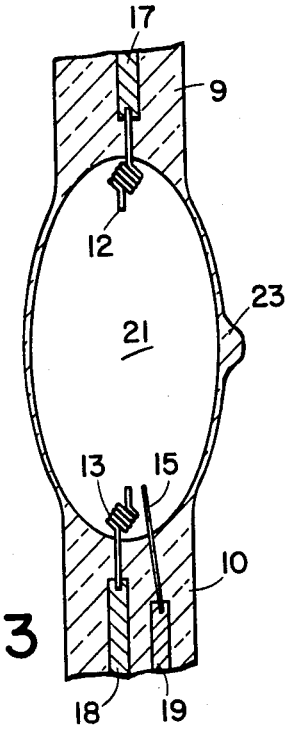
FIG. 3 is a sectional side view of the arc tube of FIG. 2.

The inventive arc tube, shown more particularly in FIGS. 2 and 3, includes a quartz vessel 5 having an approximately ellipsoidal inner surface 7 with pressed ends 9, 10. Inserted into the pressed ends are main electrodes 12, 13, which in the preferred embodiment are identical, and a starter electrode 15.

The electrode 12, consisting of a length of thoriated tungsten wire as more fully discussed below, is inserted into the pressed end 9, and welded to a molybdenum strip 17. Similarly, the main electrode 13 and starter electrode 15 are inserted in the pressed end 10 and are welded to respective molybdenum strips 18, 19.

To provide a highly isothermal construction, the dimensions of the vessel 5 and the insertion of the electrodes 12, 13 provide a relatively long arc with respect to the vessel cavity. In a preferred embodiment for 250 Watt operation, the tip-to-tip spacing L of the electrodes 12, 13 is 24 mm, while the inner surface 7 describes an ellipsoid enclosing an arc chamber 21 having a major diameter or length of 34 mm, and a minor diameter of 16 mm, the cross-section of the vessel taken transversely to the longitudinal axis being circular. The vessel thus has a distance F of 30 mm between ellipse foci. For operation with the pressure and power rating listed below, the vessel is selected to have a wall thickness of approximately 1 mm.

Experimental lamps having these approximate dimensions were made and tested to determine the extent of color improvement that might be obtained. Values for these lamps are shown in Table 1, for two different additives: additive A utilized 0.4 mg of thallium iodide, 5.5 mg of calcium iodide and 2.5 mg of tin iodide; additive B was the same except that it contained 6.6 mg calcium iodide. The data shown reflect values after 100 hours of operation.

TABLE 1

| LAMP # | Hg dose | Fill | Volt. | Curr. | Watt. | LPW | CCT | CRI | CPI | MPCD |
|---|---|---|---|---|---|---|---|---|---|---|
| 1 | 36 mg | A | 135.6 | 2.131 | 250 | 64.8 | 4285 | 71.8 | 106.3 | 25 |
| 2 | 40 mg | A | 141.9 | 2.037 | 250 | 64.6 | 4166 | 70.3 | 104.1 | 26 |
| 3 | 34 mg | B | 131.7 | 2.167 | 250 | 60.3 | 3780 | 77.9 | 109.4 | 17 |
| 4 | 38 mg | A | 136.8 | 2.090 | 250 | 61.4 | 3612 | 72.8 | 111.2 | 13 |

As the Table makes clear, lamp No. 4 exhibits an extremely low "minimum perceptible color difference" while still providing more than 60 lumens per watt at a correlated color temperature of approximately 3600° K. The color preference index is also exceptionally high.

Arc Tube Processing

In order to obtain reliable starting with the excellent properties shown in this Table, an arc tube processing schedule was followed which greatly reduces the problem of moisture contamination of the finished product.

The ellipsoidal arc tube with its electrodes sealed into the press at each end, and having an exhaust tubulation approximately 125 mm long, was evacuated and flushed with inert gas, and baked, operated with an argon fill, reevacuated and dosed.

Following these known steps in the preparation of an arc tube, the tube was back filled to a pressure between 25 and 50 Torr of argon, and the tubulation was tipped off approximately 75 mm from the arc tube. A cylindrical heater tube was then fitted around the tubulation, so as to be a close fit and to extend along the entire length of the tubulation up to a point very close (for example 1 to 2 mm spacing) from the arc tube ellipsoid. The heater tube was then raised to a temperature between 700° and 800° C. After the temperature of the heater and tubulation had stabilized, the arc tube was lit and run at a power level at least 100% and not more than 150% of a rated wattage, for a period of 5 to 10 minutes. After this operating period, the arc was extinguished and the heater was then turned off. Because of the differences in thermal mass, the arc tube cooled much faster than the tubulation, so that substantially all the additive materials condensed within the arc tube.

After cooling, the heater was removed from around the tubulation, and the tubulation lightly scored near the tip and inserted into a breaker valve. The tubulation was then broken at the tip and immediately evacuated, for example to a vacuum of $10^{-4}$ Torr or better.

Preferably, a higher vacuum is pulled, but if back streaming of lubricants from the vacuum system presents a contamination problem, the sequence of a lower vacuum, followed by flush with argon, followed by reevacuation may be necessary. Finally, the "Penning" fill is completed by introducing argon, preferably to an argon pressure of at the location 23 shown in FIG. 3 50 Torr, and the tubulation is tipped off close to the ellipsoid.

With this procedure, virtually none of the special additives are lost into the vacuum system. As a result, not only is there is a much tighter control on the fill of the final product, but the damage to the vacuum system, caused in particular by iodides, is eliminated.

Electrodes

Figure 4:
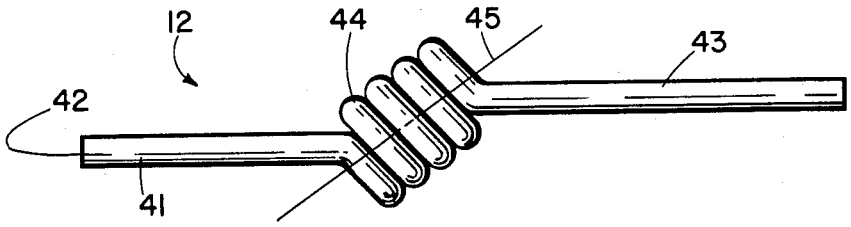
FIG. 4 is a view, greatly enlarged, of the main electrodes of the arc tube of FIGS. 2 and 3.

To ensure that, during operation, the arc makes the transition from the coil where it initially terminates, to the electrode tip, and then maintains an efficient "hot spot" operation on the tip, in a preferred embodiment of the lamp the electrodes 12, 13 are formed as shown in FIG. 4. Rather than comprising a thoriated tungsten central post, about which some turns of tungsten wire have been wound tightly in order to provide cavities for arc initiation, the electrode is a unitary element formed of a length of a thoriated tungsten wire. An electrode which can readily be fabricated using conventional equipment has a tip end 41, whose end face 42 is the tip at which hot spot operation is desired. Opposite the tip end, a connection end 43 is provided of such length that it can be conventional welded to a molybdenum strip for insertion into the pressed end of the arc tube. Between these ends, the length of wire is wound as a coil 44, which preferably has an inside diameter (winding mandrel diameter) slightly greater than the wire diameter. To avoid sharp bends in the wire, and to permit use of conventional coil winding equipment, the ends 41 and 43 extend at an angle with respect to the axis 45 of the coil portion. Preferably these ends 41 and 43 are parallel to each other, so that alignment of the electrode in the pressed end of the arc tube is simplified, it being desirable that the tip 42 of the electrode be on the longitudinal axis of the ellipsoid.

For use in a 250 Watt metal halide lamp, the presently preferred dimensions involve 0.53 mm (0.021") wire diameter, having $4\frac{1}{4}$ turns wound about a 0.76 mm (0.030") mandrel with approximately 105% pitch. The tip extends approximately 2 mm from the coil. The electrode wire used has the same composition as that used for the prior art electrode posts, typically a thoriated tungsten containing from 1% to $1\frac{1}{2}$% thorium.

Figure 5:
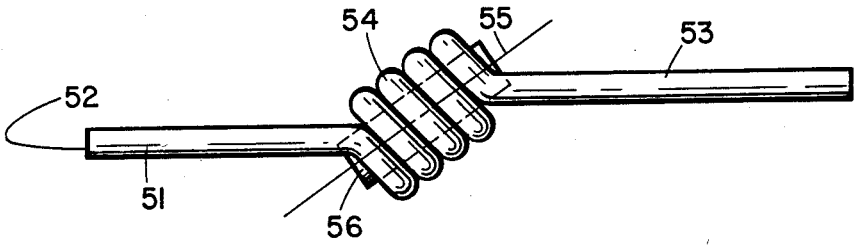
FIG. 5 is a view of an electrode similar to FIG. 4 but having a short core within the core.

In order to provide additional cavity spots at which arc termination may initiate, according to another electrode embodiment shown in FIG. 5 a wound element having tip end 51, tip 52, connection end 53 and coil 54 on an axis 55 is prepared as in FIG. 4, and a tungsten slug or core 56 is then inserted within the coil 54. The core slug preferably has a diameter such that the coil fits tightly about the slug and is approximately the same length or may extend slightly beyond the full turns of the coil.

Figure 6:
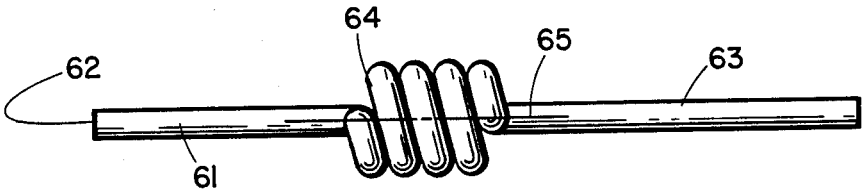
FIG. 6 is a view of an alternative shape of electrode in accordance with the invention.

It will be clear that symmetrical formation of the electrode for mounting in the arc tube is preferable, so that the electrode shape shown in FIGS. 4 and 5 represents a production compromise. A unitary electrode shown in FIG. 6 has a tip end 61, with tip 62, coaxial with a connection end 63 and the axis 65 of the coil 64. This construction requires relatively sharp bends in the wire at the transitions from the coil to the connection and tip ends, as is well known to those experienced in the filament winding art. According to yet another embodiment, not shown separately in the drawing, an electrode similar to that of FIG. 6 may be prepared having a short core inserted within the coil after winding the basic turns, and before forming the two ends to the coaxial position. Such a construction offers not only additional cavities for arc initiation, but will also provide support for the coil during the process of forming the transitions to the connection end 63 and the tip end 61.

It will be clear to those of ordinary skill in the HID art that many variations of the above described embodiments are possible within the spirit of the invention. An ellipsoidal interior shape of the quartz vessel 5 is desirable from the standpoint of isothermal performance and strength, but may be modified slightly in order to provide production economies or improved isothermal performance for a particular electrode configurations. The exact arc length or electrode separation, may be greater than the preferred value or minima listed, although it appears undesirable that the arc length exceed the distance between the ellipsoid foci.

The exact configuration of the tubulation used for filling and processing of the arc tube is selected primarily in accordance with the manufacturing machinery to be used. While it normally will lie near the middle of the ellipsoid it may lie either in the-plane of the pressed ends (as shown by the tip-off location 23 in FIG. 3), or perpendicular to that plane, or at some intermediate angle. The exact length and diameters of the tubulation are not critical either. The tubulation must be long enough for convenience in handling in the breakoff, re-tipping operation and to permit effective heating of the tubulation separate from the arc tube when the tube is lit following dosing.

In accordance with general practice of the art, to permit rapid effective evacuation, the arc tube for a lamp such as the 250 Watt example would typically have a 2 mm tubulation bore, while high powered lamps might use a 3 mm bore and small low power lamps might be as small as 1 mm.

What is claimed:

1. A high intensity discharge lamp comprising
an isothermally shaped arc tube enclosing a space,
an ionizable material contained in said space,
at least two electrodes arranged in said space for establishment of an arc between said electrodes, and
means for connecting said electrodes to a source of electric current,
characterized in that
said ionizable material comprises an additive fill of calcium iodide, thallium iodide, and tin iodide,
said arc tube is substantially ellipsoidal in shape, having circular symmetry about a longitudinal axis which is the major ellipsoid axis,
said electrodes have electrode tips lying substantially along said axis, and spaced so as to define an arc length which is at least 75% of the distance between the ellipsoid foci, and
said arc tube has a size such that, when operated at rated wattage, the cold spot temperature on said arc tube is at least 770° C. when installed in any orientation.

2. A lamp as claimed in claim 1, comprising as additives approximately 0.1 mg/cc thallium iodide, 0.625 mg/cc tin iodiode and 1.375 mg/cc calcium iodide, having a rated wattage such that the maximum operating temperature along the arc tube wall is less than 1000° C., whereby a color preference index greater than 100 is provided without sacrificing lamp life.

3. A lamp as claimed in claim 2, characterized in that said tip spacing defines an arc length at least 80% of the distance between the ellipsoid foci.

4. A lamp as claimed in claim 2, characterized in that said tip spacing defines an arc length which is approximately 83% of the distance between the ellipsoid foci.

* * * * *